US008563884B2

(12) United States Patent
Palmer et al.

(10) Patent No.: US 8,563,884 B2
(45) Date of Patent: Oct. 22, 2013

(54) MANUAL RESET PRESSURE SWITCH

(75) Inventors: Brian L. Palmer, Michigan City, IN (US); Christina A. Bentley, Michigan City, IN (US)

(73) Assignee: Dwyer Instruments, Inc., Michigan City, IN (US)

( * ) Notice: Subject to any disclaimer, the term of this patent is extended or adjusted under 35 U.S.C. 154(b) by 484 days.

(21) Appl. No.: 12/978,838

(22) Filed: Dec. 27, 2010

(65) Prior Publication Data

US 2011/0174602 A1 Jul. 21, 2011

Related U.S. Application Data

(60) Provisional application No. 61/297,012, filed on Jan. 21, 2010.

(51) Int. Cl.
*H01H 35/24* (2006.01)
*H01H 35/26* (2006.01)

(52) U.S. Cl.
USPC ..... 200/81 R; 200/83 A

(58) Field of Classification Search
USPC ..... 200/5 A, 553, 335
See application file for complete search history.

(56) References Cited

U.S. PATENT DOCUMENTS

| | | | | |
|---|---|---|---|---|
| 2,381,835 | A | | 8/1945 | Moorehead |
| 3,760,138 | A | | 9/1973 | Reis |
| 3,760,139 | A | | 9/1973 | Porter, Jr. |
| 4,631,374 | A | | 12/1986 | Zoludow |
| 4,709,126 | A | | 11/1987 | Miller et al. |
| 4,725,700 | A | | 2/1988 | Zoludow |
| 4,827,095 | A | | 5/1989 | Clark et al. |
| 5,047,601 | A | * | 9/1991 | Edwards et al. ..... 200/81 R |
| 5,061,832 | A | | 10/1991 | Squires |
| 5,183,983 | A | | 2/1993 | Knop |
| 5,352,858 | A | | 10/1994 | Keck |
| 6,089,098 | A | | 7/2000 | Tylisz et al. |
| 6,452,122 | B1 | | 9/2002 | LeRoy |
| 6,981,421 | B2 | | 1/2006 | Palmer et al. |

FOREIGN PATENT DOCUMENTS

| | | |
|---|---|---|
| GB | 860759 | 2/1961 |
| GB | 1350488 A | 4/1974 |
| GB | 1477892 A | 6/1977 |

* cited by examiner

*Primary Examiner* — Renee Luebke
*Assistant Examiner* — Lheiren Mae Caroc
(74) *Attorney, Agent, or Firm* — Barnes & Thornburg LLP

(57) ABSTRACT

A switching device including a plurality of electrical switches, and an activation lever adapted to substantially simultaneously change the switches from a first state to a second state in response to a single physical input.

24 Claims, 8 Drawing Sheets

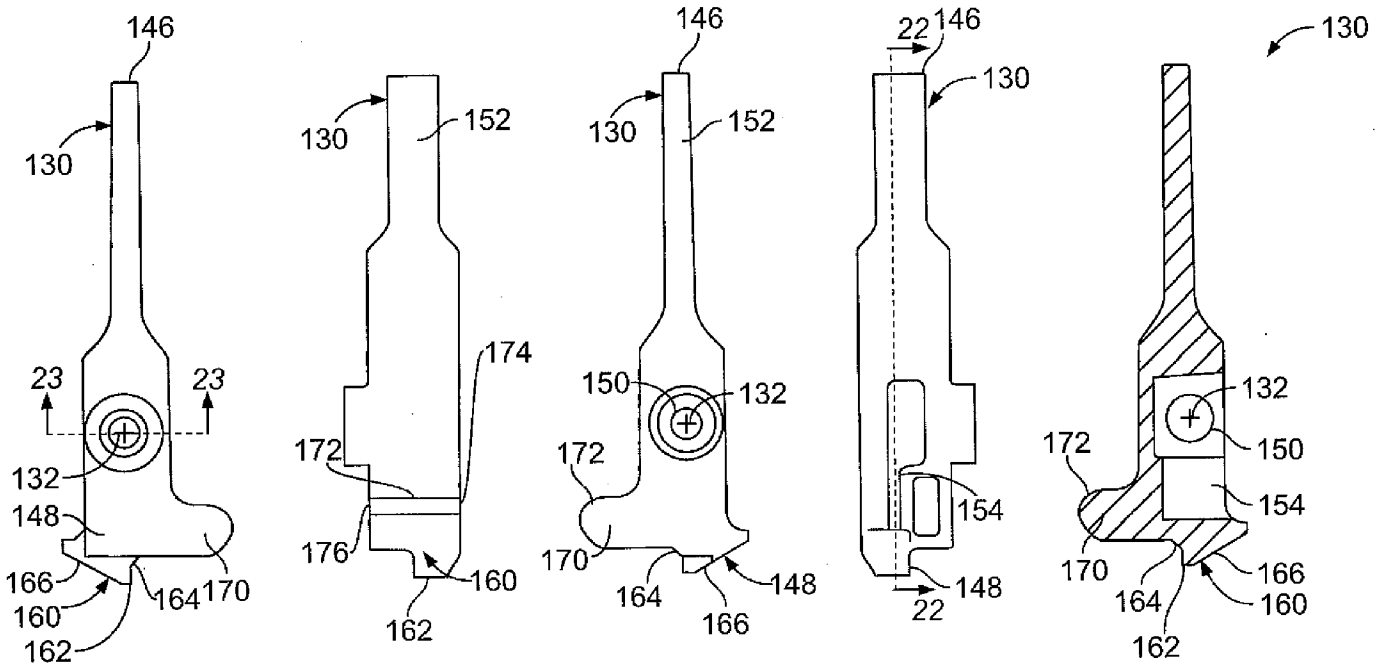
FIG. 18
FIG. 19
FIG. 20
FIG. 21
FIG. 22
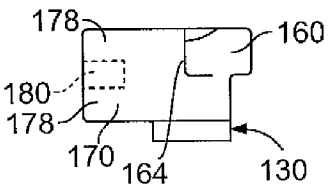
FIG. 24
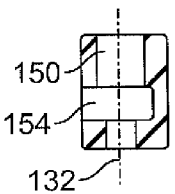
FIG. 23

MANUAL RESET PRESSURE SWITCH

RELATED APPLICATIONS

This application claims the benefit of U.S. Provisional Application No. 61/297,012, filed Jan. 21, 2010.

BACKGROUND

The present disclosure is directed to a switch mechanism including one or more electrical switches that are adapted to be changed from a first state to a second state in response to a physical input, and in particular to a switch mechanism including a plurality of electrical switches that are adapted to be changed from their first states to their second states at substantially the same time in response to a single physical input.

DESCRIPTION OF THE DRAWING FIGURES

FIG. 18 is a right side view of the activation lever;

FIG. 19 is a front elevation view of the activation lever;

FIG. 20 is a left side view of the activation lever;

FIG. 21 is a rear elevation view of the activation lever;

FIG. 22 is a cross sectional view taken along line 22-22 of FIG. 21;

FIG. 23 is a cross sectional view taken along line 23-23 of FIG. 18;

FIG. 24 is a bottom view of the activation lever; and

DETAILED DESCRIPTION

Figure 1:
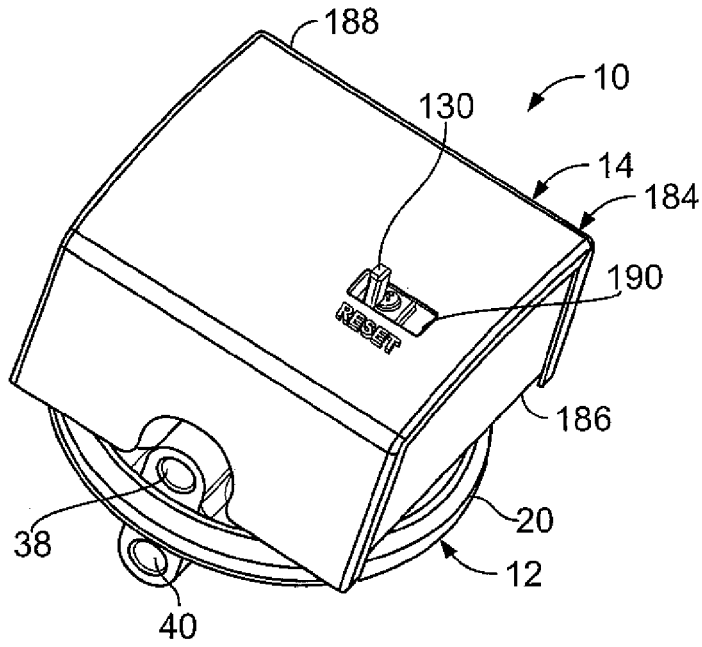
FIG. 1 is a perspective view of a pressure switch including the switch mechanism of the present disclosure.

The present disclosure relates to a switching device including a sensing mechanism and a switch mechanism, wherein the sensing mechanism provides a physical input, such as a force, to actuate the switch mechanism. An embodiment of the switching device is shown in the drawing figures as a pressure switch 10 including a pressure sensing mechanism 12 adapted to provide a physical input, such as a force, to a switch mechanism 14. The switching device may alternatively comprise, for example, a rotary position switching device wherein the sensing mechanism comprises a rotary position sensor, a linear level switching device wherein the sensing mechanism comprises a linear level sensor, or a fluid flow switching device wherein the sensing mechanism comprises a fluid flow sensor.

Figure 6:
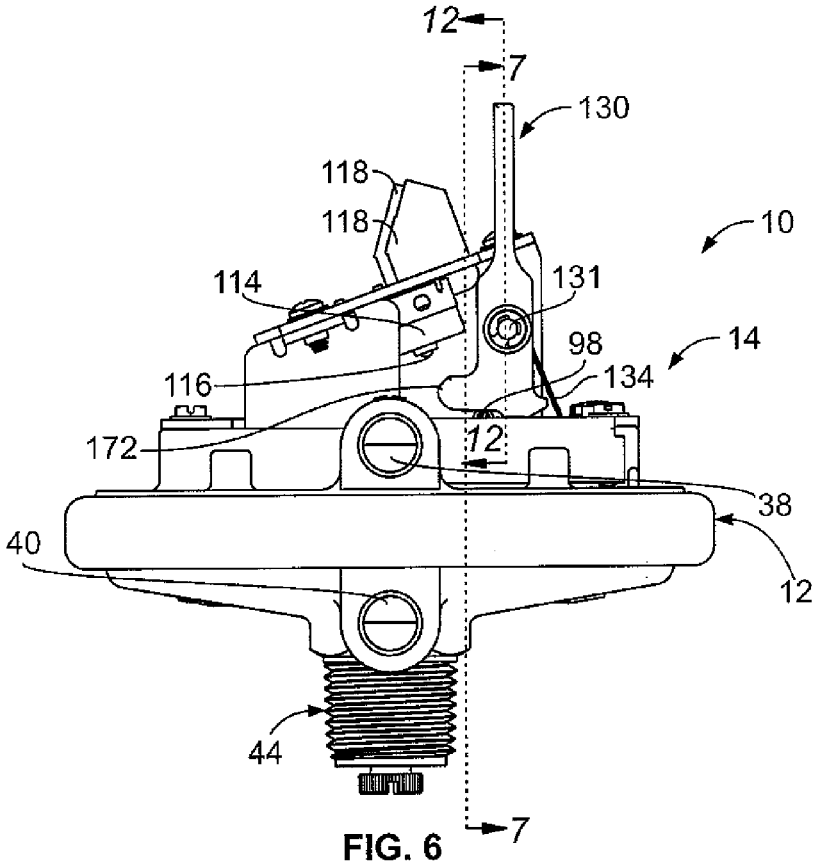
FIG. 6 is a partial side elevational view of the pressure switch with the housing removed and the activation lever shown in the normal position.
Figure 7:
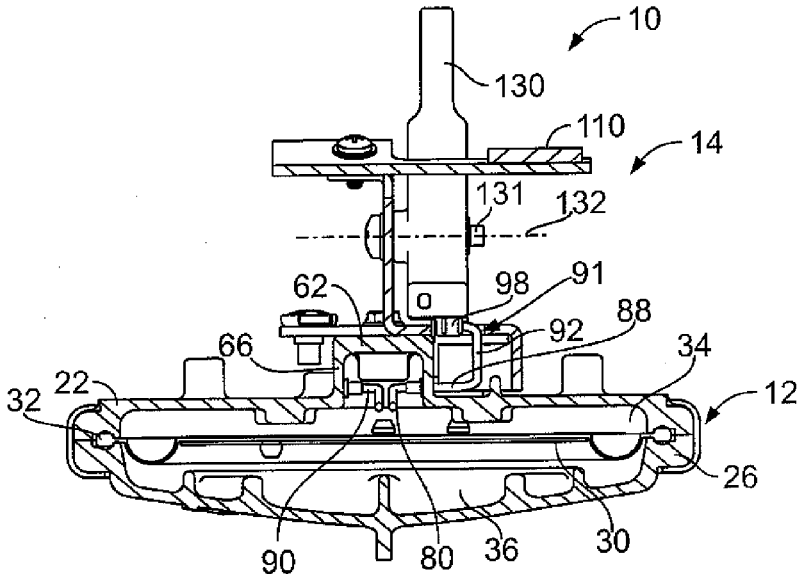
FIG. 7 is a cross sectional view taken along line 7-7 of FIG. 6.

Pressure sensing mechanism 12 includes a housing 20. Housing 20 includes a top housing portion 22 having a generally circular peripheral flange 24 and a bottom housing portion 26 having a generally circular peripheral flange 28. A resiliently flexible diaphragm 30 having a generally circular peripheral edge 32 is located and sealed between top housing portion 22 and bottom housing portion 26 with edge 32 of diaphragm 30 located between flange 24 of top housing portion 22 and flange 28 of bottom housing portion 26. Pressure sensing mechanism 12 includes a first fluid chamber 34 formed between diaphragm 30 and top housing portion 22, and a second fluid chamber 36 formed between diaphragm 30 and bottom housing portion 26. As shown in FIG. 6, top housing portion 22 includes a first port 38 in fluid communication with first fluid chamber 34 and a second port 40 in fluid communication with second fluid chamber 36.

Pressure sensing mechanism 12 includes a stem 44 attached to bottom housing portion 26. Stem 44 extends along a generally linear central axis 46 of pressure sensing mechanism 12. Flanges 24 and 28 of top and bottom housing portions 22 and 26 extend generally concentrically about axis 46. Diaphragm 30 extends generally concentrically about axis 46 and generally perpendicular to axis 46. Stem 44 is externally threaded for coupling to a mounting member. Stem 44 includes an internal bore 45 extending along axis 46.

Figure 25:
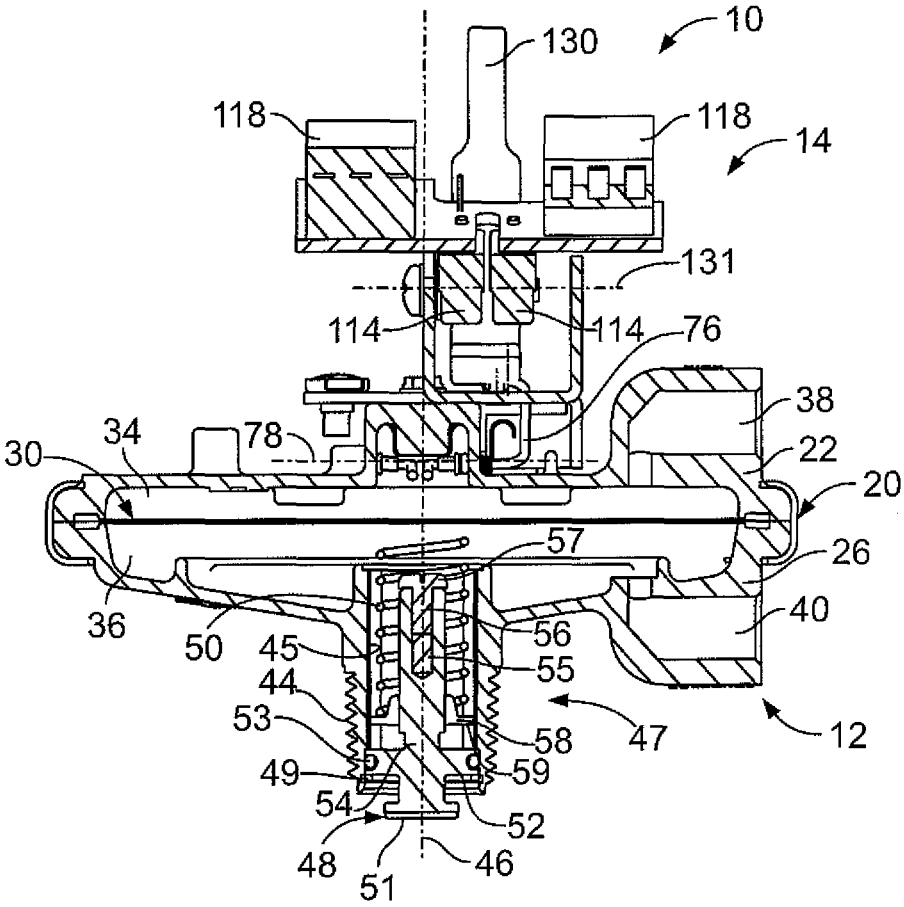
FIG. 25 is a cross sectional view taken along line 25-25 of FIG. 4.

Pressure sensing mechanism 12 includes a calibration mechanism 47, as best shown in FIG. 25, including an adjustment member 48 located within the bore 45 of stem 44. Adjustment member 48 is selectively rotatable about axis 46 in either a clockwise or counter-clockwise direction. Adjustment member 48 is rotatably retained in bore 45 by a retention member 49, such as a snap-ring or e-type ring. Adjustment member 48 includes a head 51 located externally of stem 44 and a generally circular flange 52 located within bore 45. Flange 52 includes a generally circular edge. A resilient seal member 53, such as an O-ring, is located around the edge of flange 52 and between flange 52 and a generally circular side wall portion of bore 45 of stem 44 to create a fluid-tight seal between flange 52 and bore 45 of stem 44, while allowing adjustment member 48 to rotate about axis 46 with respect to stem 44. Adjustment member 48 includes an externally threaded shaft 54 that extends from flange 52 toward diaphragm 30 along axis 46. Shaft 54 includes an internally threaded bore 55 that extends inwardly from a distal end of shaft 54 along axis 46. A stop member 56, such as a screw or bolt, is threadably attached to bore 55 of shaft 54 for conjoint rotation with shaft 54 about axis 46. Stop member 56 includes a head 57 at the distal end of shaft 54 that extends radially outwardly beyond the external circumference of shaft 54.

The calibration mechanism 47 includes a guide member 58 threadably attached to shaft 54 of adjustment member 48. Guide member 58 includes an outwardly extending flange 59 having a generally polygonal-shaped peripheral edge, such as a hexagonal-shaped peripheral edge, adapted to mate with a generally polygonal-shaped wall portion, such as a hexagonal-shaped side wall portion, of bore 45 that extends from adjacent flange 52 of adjustment member 48 to the distal end of bore 45. The hexagonal-shaped side wall portion of bore 45 prevents guide member 58 from rotating with respect to stem 44 when adjustment member 48 is rotated about axis 46 with respect to stem 44. Adjustment member 48 is rotatable about axis 46 with respect to guide member 58 in either a clockwise or counter-clockwise direction. Adjustment member 48 may be selectively rotated about axis 46 to either advance guide member 58 toward diaphragm 30 and top housing portion 22, or retract guide member 58 away from diaphragm 30 and top housing portion 22, along axis 46. Head 57 of stop member 56 is adapted to engage guide member 58 when guide member 58 advances to the distal end of shaft 54 to prevent guide member 58 from advancing beyond the distal end of shaft 54.

A resilient biasing member 50, such as a helical coil spring, extends along axis 46 and at least partially within bore 45 between guide member 58 and diaphragm 30. Biasing member 50 includes a distal end adapted to engage the diaphragm 30 and a proximal end adapted to engage guide member 58. Biasing member 50 is adapted to resiliently bias diaphragm 30 along axis 46 toward first fluid chamber 34 and top housing portion 22 with a resilient biasing force. The biasing force with which biasing member 50 engages diaphragm 30 may be selectively adjusted by manually advancing guide member 58 along axis 46 to increase the biasing force, or by manually retracting guide member 58 along axis 46 to decrease the biasing force, provided by biasing member 50.

First port 38 may be coupled to a first fluid supply line for providing a first fluid to first fluid chamber 34 at a first pressure, and second port 40 may be coupled to a second fluid supply line for providing a second fluid to second fluid chamber 36 at a second pressure. Typically, the pressure of the fluid in the first fluid chamber 34 is greater than the pressure of the fluid in the second fluid chamber 36. To the extent the pressure of the first fluid in first fluid chamber 34 is greater than the pressure of the second fluid in second fluid chamber 36, the first fluid will exert a net fluid force on diaphragm 30 and will move diaphragm 30 along axis 46 toward second fluid chamber 36 and bottom housing portion 26 while compressing biasing member 50, until biasing member 50 is sufficiently compressed to exert a biasing force on diaphragm 30 that is equal to and opposite in direction to the net fluid force applied to diaphragm 30 by the first fluid in first fluid chamber 34. The greater the pressure differential there is between the first fluid of first fluid chamber 34 and the second fluid of second fluid chamber 36, the farther diaphragm 30 will move along axis 46 toward bottom housing portion 26 while compressing biasing member 50. Diaphragm 30 will thereby be located at a selected position along axis 46, and at a selected location between bottom housing portion 26 and top housing portion 22, when there is a particular pressure differential between the first fluid in first fluid chamber 34 and the second fluid in second fluid chamber 36.

Figure 13:
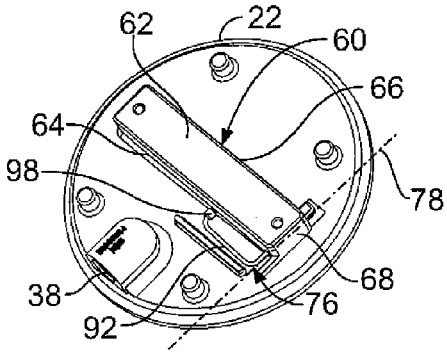
FIG. 13 is top perspective view of the mounting base of the switch mechanism shown coupled to the top of the diaphragm housing of the pressure switch.

Switch mechanism 14 includes a mounting base 60 coupled to top housing portion 22 of housing 20. Mounting base 60 as shown in FIG. 13 is generally elongate and rectangular and includes a generally planar top wall 62, a first side wall 64, a second side wall 66, and a pair of spaced apart end walls 68. First side wall 64 and second side wall 66 are spaced apart and generally parallel to one another and are generally perpendicular to top wall 62. Mounting base 60 forms a chamber 70 between first and second side walls 64 and 66, end walls 68, and top wall 62. Chamber 70 is in fluid communication with first fluid chamber 34.

Figure 15:
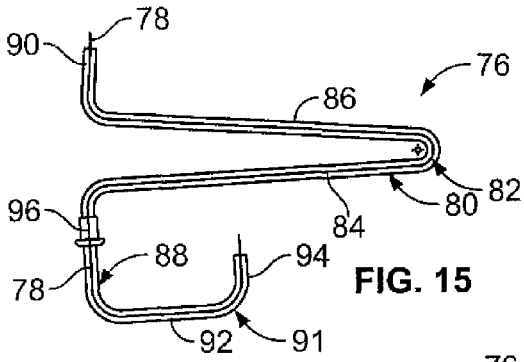
FIG. 15 is a top plan view of the linkage lever of the switch mechanism.
Figure 16:
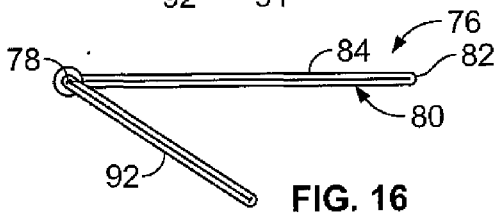
FIG. 16 is a side elevational view of the linkage lever.
Figure 17:
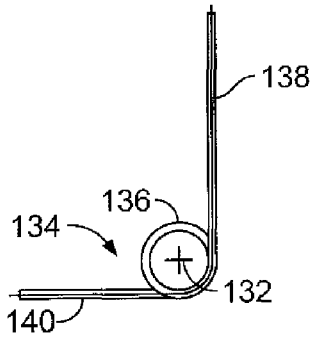
FIG. 17 is a side elevational view of the torsion spring for the activation lever.

Switch mechanism 14 includes a linkage lever 76 pivotally coupled to first side wall 64 and second side wall 66 of mounting base 60 for pivotal movement about a pivot axis 78 with respect to mounting base 60 and housing 20. As shown in FIGS. 15 and 16, linkage lever 76 includes a leg 80 having a distal tip 82. Tip 82 is adapted to be coupled to diaphragm 30, such as by engagement of tip 82 with diaphragm 30. As shown in FIG. 15, leg 80 may comprise a generally linear first member 84 and a generally linear second member 86 that are coupled together at their distal ends at tip 82 and that are formed in a generally V-shaped manner. A generally cylindrical first pivot member 88 extends outwardly from a proximal end of first member 84 generally perpendicular to first member 84. A generally cylindrical second pivot member 90 extends outwardly from and generally perpendicular to a proximal end of second member 86. First pivot member 88 is adapted to extend through an aperture in first side wall 64 of mounting base 60 and second pivot member 90 is adapted to extend into a fluid tight blind aperture formed in second side wall 66 of mounting base 60, such that first pivot member 88 and second pivot member 90 extend generally coaxially along pivot axis 78. Linkage lever 76 includes a pawl 91 having an arm 92 that extends outwardly from and generally perpendicular to first pivot member 88. As shown in FIG. 16, arm 92 extends downwardly at an angle with respect to first and second members 84 and 86 of leg 80. Pawl 91 includes a finger 94 that extends inwardly and generally perpendicularly from the distal end of arm 92 toward leg 80. Arm 92 and finger 94 are located externally to mounting base 60. Leg 80, including first and second members 84 and 86, are located within chamber 70 of mounting base 60. Linkage lever 76 may be formed from a continuous generally cylindrical metal wire such that linkage lever 76 is resiliently flexible.

Figure 14:
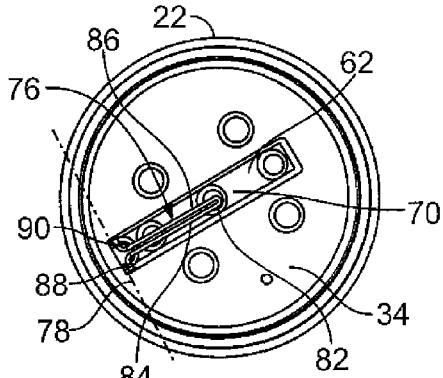
FIG. 14 is a bottom perspective view of the mounting base for the switch mechanism as shown from the interior of the diaphragm housing.

As shown in FIG. 14, when linkage lever 76 is pivotally mounted to mounting base 60, proximal ends of first and second members 84 and 86 are pressed inwardly together toward one another such that first and second members 84 and 86 are generally parallel to one another. A bushing 96 extends around first pivot member 88 and a bushing 96 extends around second pivot member 90. Proximal ends of first member 84 and second member 86 respectively bias bushings 96 toward first and second side walls 64 and 66 of mounting base 60. A resilient seal member 97, such as an O-ring, extends around first pivot member 88 and is pressed into engagement with the first side wall 64 to thereby create a fluid tight seal between first pivot member 88 and first side wall 64, while allowing pivotal movement of linkage lever 76 about pivot axis 78. A washer may be located around first pivot member 88 and between bushing 96 and seal member 97. Pawl 91 may include a roller 98 rotatably attached to finger 94 for rotational movement about finger 94.

Figure 11:
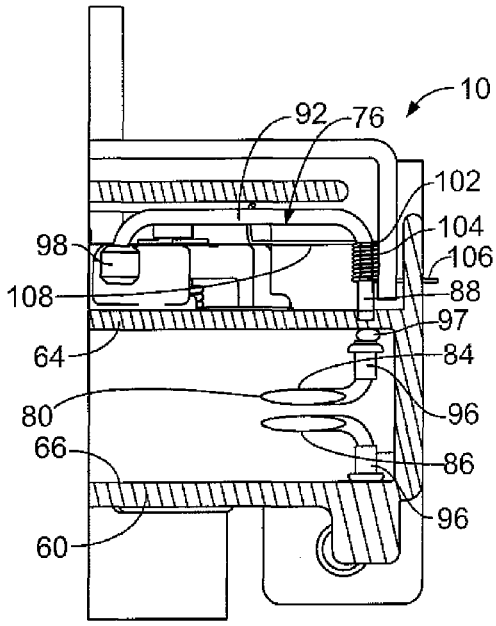
FIG. 11 is a cross sectional view taken along line 11-11 of FIG. 8.
Figure 12:
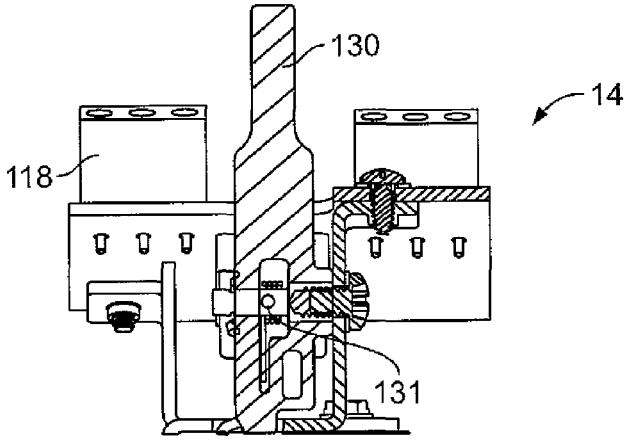
FIG. 12 is a cross sectional view taken along line 12-12 of FIG. 6.

A resilient biasing member such as a torsion spring 102, as shown in FIG. 11, resiliently biases linkage lever 76 about pivot axis 78 to resiliently press tip 82 of linkage lever 76 in coupled engagement with diaphragm 30, such that tip 82 will remain in engagement with diaphragm 30 as diaphragm 30 moves along axis 46 in response to changes in the pressure differential between the fluids in first fluid chamber 34 and second fluid chamber 36. Tip 82 of linkage lever 76 thereby moves conjointly with diaphragm 30. Torsion spring 102 includes a helical coil 104 that extends around first pivot member 88 of linkage lever 76, a first leg 106 in biased engagement with mounting base 60, and a second leg 108 in biased engagement with arm 92 of linkage lever 76.

Switch mechanism 14 includes a circuit board 110 coupled to mounting base 60 with a bracket 112. One or more electrical switches 114 are electrically coupled to circuit board 110 in alignment with one another. Each switch 114 includes an actuation member, such as a button or plunger 116. One or more electrical wire terminal blocks 118 are electrically coupled to circuit board 110. Each terminal block 118 is electrically coupled to a respective electrical switch 114. Each terminal block 118 is electrically connectable to one or more operable devices or pieces of equipment, such as pumps, blowers, valves and the like, that are to be controlled by the pressure switch 10. Plunger 116 of each switch 114 is adapted to change the switch 114 from a normal state, when an activation force is not applied to plunger 116, to an actuated state, when an activation force is applied to plunger 116. Each switch 114 changes from the actuated state to the normal state when the activation force is removed from its plunger 116. Switch mechanism 14 may include a plurality of switches 114 electrically coupled to one or more operable devices or pieces of equipment, such as pumps, blowers, valves and the like, for controlling operation of one or more of the operable devices or pieces of equipment. The plurality of switches 114 may be aligned with one another such that all of the plungers 116 are linearly aligned with one another along a common axis. An isolation shield 120 may overlie a portion of circuit board 110 and may be attached to circuit board 110 to prevent a user from coming into physical contact with the covered portion of circuit board 110. Shield 120 may be formed as a thin flexible sheet of plastic or from other materials as desired.

Figure 5:
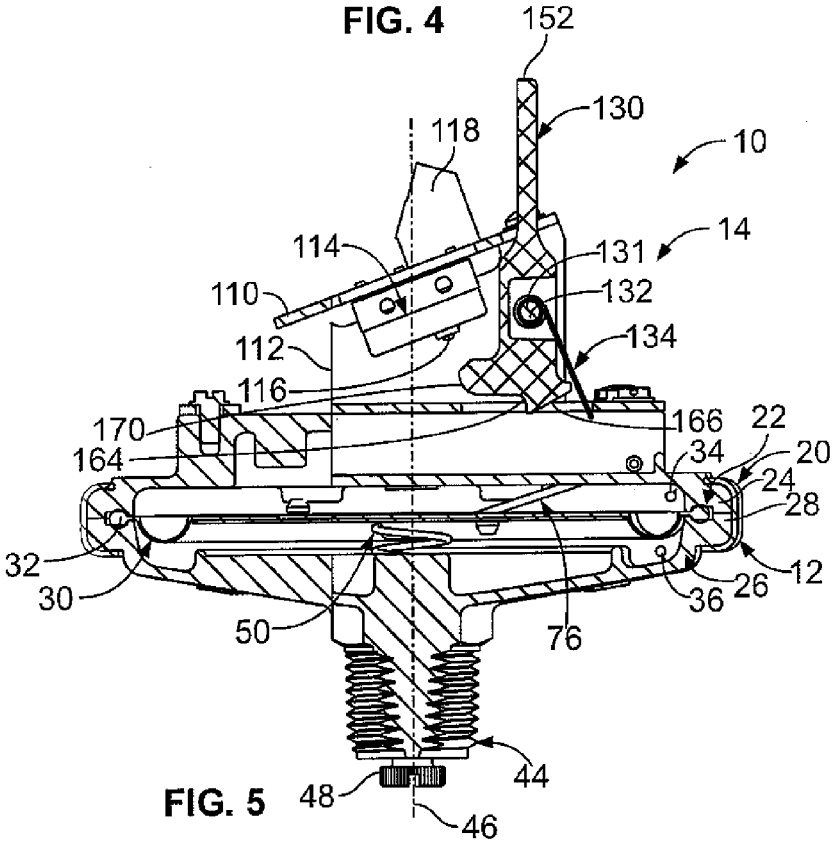
FIG. 5 is a cross sectional view taken along line 5-5 of FIG. 4.
Figure 8:
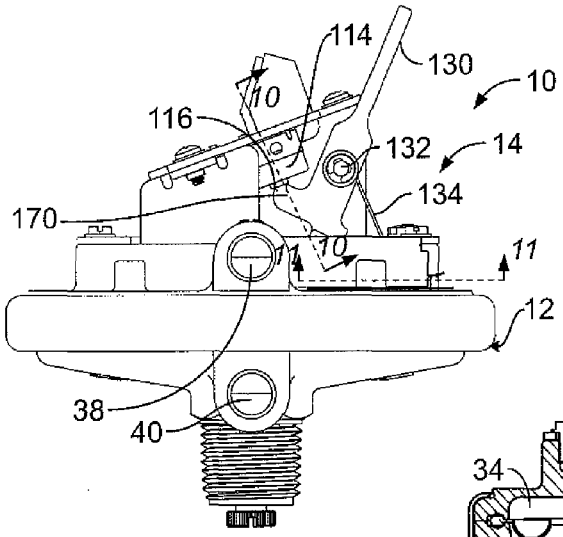
FIG. 8 is a partial side elevational view of the pressure switch with the housing removed and the activation lever shown in the actuated position.
Figure 9:
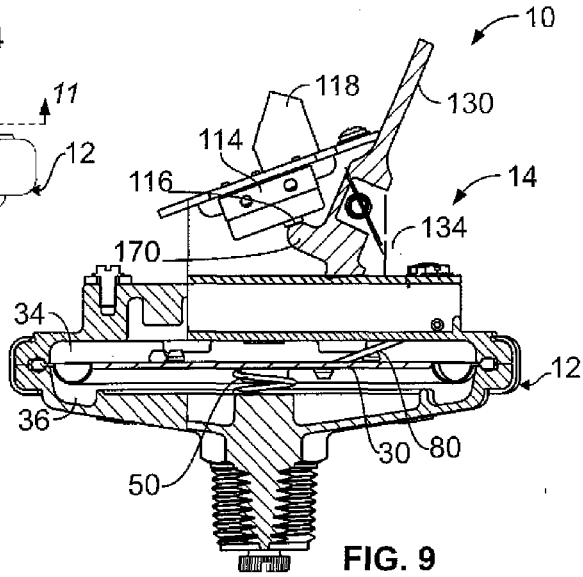
FIG. 9 is a cross sectional view of the pressure switch with the housing removed and the activation lever shown in the actuated position.
Figure 10:
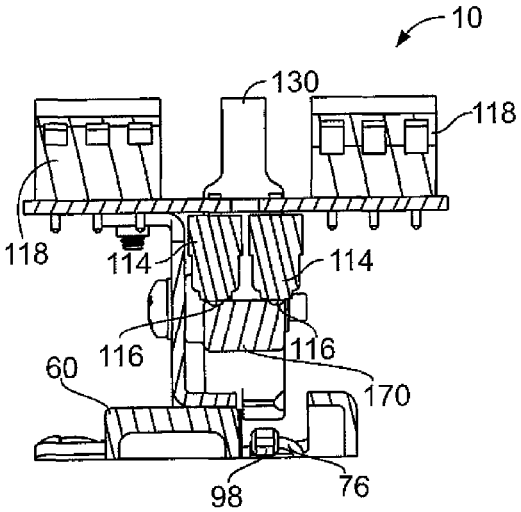
FIG. 10 is a cross sectional view taken along line 10-10 of FIG. 8.

Switch mechanism 14 includes an activation lever 130 pivotally coupled to bracket 112 for pivotal movement about a pivot axis 132. Activation lever 130 is coupled to bracket 112 by a shaft 131 including central pivot axis 132. Pivot axis 132 of activation lever 130 is located generally parallel to pivot axis 78 of linkage lever 76. Activation lever 130 is selectively pivotal about pivot axis 132 between a normal position as shown in FIGS. 5 and 6, and an actuated position as shown in FIGS. 8 and 9. A resilient biasing member such as a torsion spring 134 resiliently biases activation lever 130 from the normal position toward the actuated position about pivot axis 132. Torsion spring 134 includes a generally helical coil 136 that extends around shaft 131, a first leg 138 in biased engagement with activation lever 130 and a second leg 140 in biased engagement with bracket 112.

Activation lever 130 includes a first end 146, a second end 148 and a transverse bore 150 located between first end 146 and second end 148. Bore 150 is adapted to receive shaft 131. First end 146 of activation lever 130 includes a tab 152 adapted to be manually engaged. The rear side of activation lever 130 includes an open channel 154 adapted to receive first leg 138 of torsion spring 134. Second end 148 of activation lever 130 includes a detent member 160 projecting outwardly along the longitudinal axis of activation lever 130. Detent member 160 includes a tip 162, a notch 164 and a retention surface 166. Notch 164 is adapted to receive roller 98 of pawl 91 of linkage lever 76 when activation lever 130 is in the normal position, such that detent member 160 and pawl 91 prevent torsion spring 134 from pivoting activation lever 130 from the normal position toward the actuated position.

Second end 148 of activation lever 130 includes an engagement member 170 that projects outwardly at generally a right angle to the longitudinal axis of activation lever 130. Engagement member 170 includes an elongate generally linear tip 172 adapted to substantially simultaneously engage all of the plungers 116 of the switches 114 when activation lever 130 is in the actuated position. Tip 172 extends generally linearly along an axis that is substantially parallel to the linear axis containing the distal ends of the plungers 116 of the switches 114, and that is generally parallel to pivot axis 132. Engagement member 170 extends between a first end 174 and a second end 176 such that engagement member 170 extends from plunger 116 of the first switch 114 to plunger 116 of the last switch 114. A single activation lever 130 may thereby simultaneously change all of the electrical switches 114 from the normal state to the actuated state when activation lever 130 pivots to the actuated position. Activation lever 130 similarly disengages from said plungers 116 of said switches 114 substantially simultaneously when activation lever 130 pivots from the actuated position toward the normal position to substantially simultaneously change all of the switches 114 from the actuated state to the normal state. Alternatively, engagement member 170 may be divided into a plurality of adjacent fingers 178 with a notch 180 between each finger 178, such that each finger 178 is adapted to engage one or more plungers 116.

Figure 2:
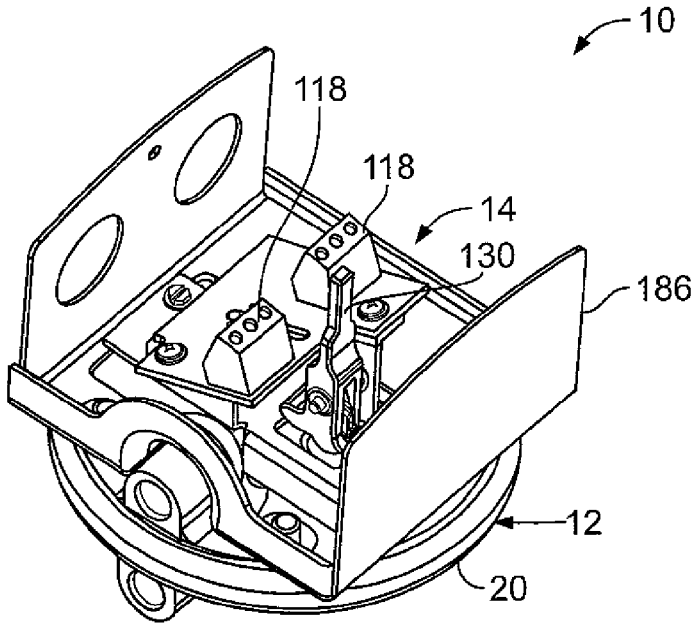
FIG. 2 is a perspective view of the pressure switch with the cover of the housing removed.
Figure 3:
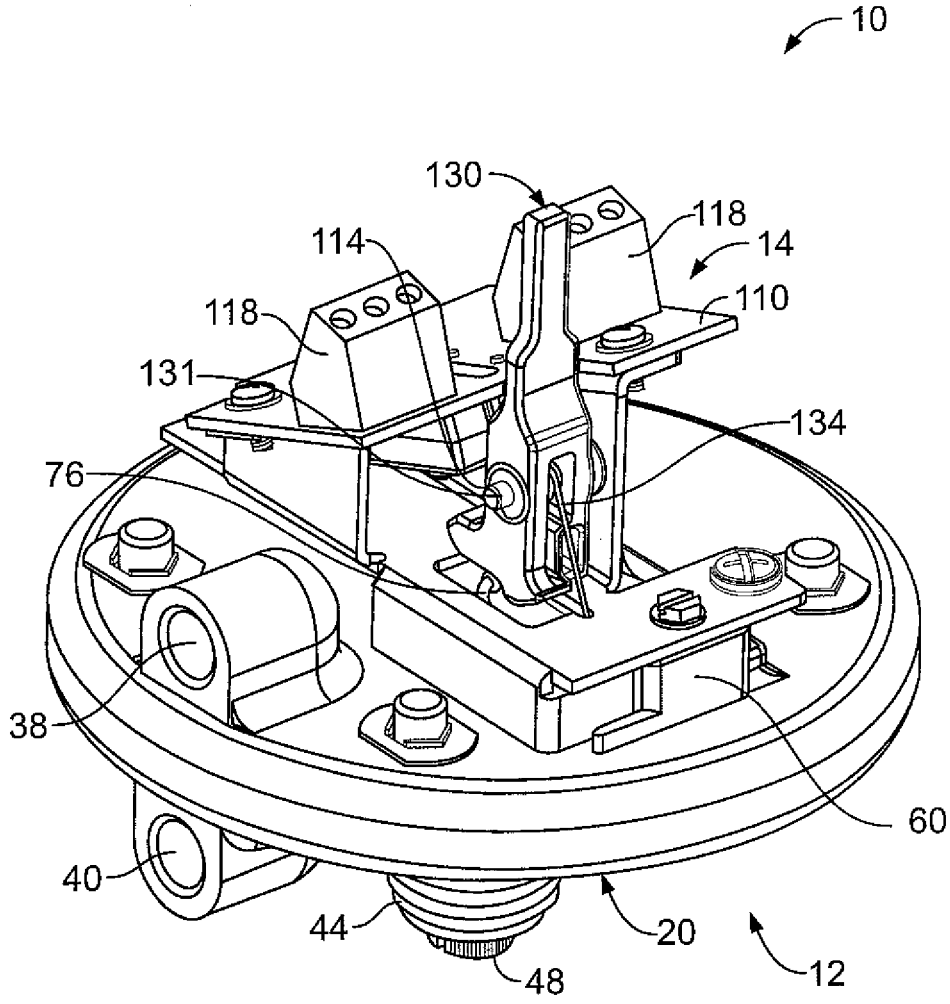
FIG. 3 is a perspective view of the pressure switch with the housing removed.
Figure 4:
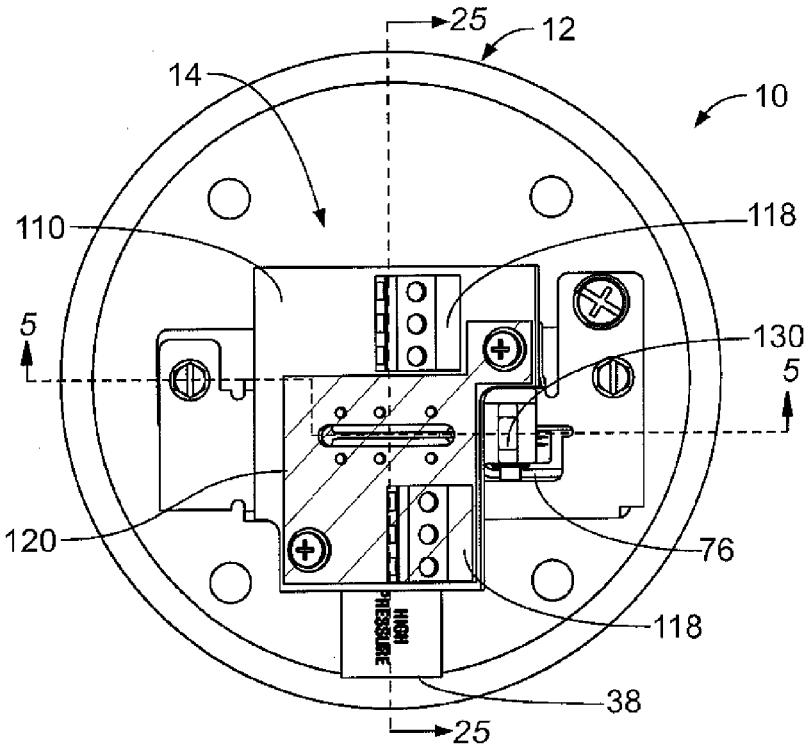
FIG. 4 is a top view of the pressure switch with the housing removed.

As shown in FIGS. 1 and 2, switch mechanism 14 includes a housing 184. Housing 184 includes a base member 186 having opposing upwardly extending end walls coupled to pressure sensing mechanism 12, and a generally U-shaped cover 188 removably coupled to base member 186. Cover 188 includes an aperture 190 through which tab 152 of activation lever 130 extends such that tab 152 may be manually engaged and moved between the normal position and the actuated position.

When the pressure of the fluid in first fluid chamber 34 is greater than the pressure of the fluid in second fluid chamber 36 by less than a pre-selected pressure differential, diaphragm 30 will be located along axis 46 in a position such that finger 94 and roller 98 of pawl 91 of linkage lever 76 will be retained within notch 164 of detent member 160 of activation lever 130, such that activation lever 130 is retained in the normal position and is prevented from pivoting to the actuated position. Switches 114 are thereby in their normal states.

When the pressure of fluid in first fluid chamber 34 is greater than the pressure of the fluid in second fluid chamber 36 by more than a selected pressure differential, diaphragm 30 will have moved along axis 46 toward second fluid chamber 36 and bottom housing portion 26. Tip 82 of linkage lever 76 will remain in engagement with diaphragm 30 when linkage lever 76 pivots in a generally counterclockwise direction as shown in FIG. 5, whereby finger 94 and roller 98 of linkage lever 76 pivot away from notch 164 of detent member 160 of activation lever 130, until finger 94 and roller 98 are sufficiently removed from notch 164 to allow torsion spring 134 to pivot activation lever 130 from its normal position toward its actuated position. When activation lever 130 pivots from its normal position to its actuated position, engagement member 170 will substantially simultaneously engage all of the plungers 116 of electrical switches 114 and will thereby substantially simultaneously change all of the switches 114 from their normal state to their actuated state. Torsion spring 134 will retain activation lever 130 in the actuated position and thereby retain switches 114 in their actuated state until activation lever 130 is manually pivoted from the actuated position to the normal position to substantially simultaneously reset the switches 114 to their normal states.

When the pressure differential between the first fluid chamber 34 and second fluid chamber 36 returns to a pressure differential that is less than the actuation pressure differential, and when the activation lever 130 is in the actuated position, finger 94 and roller 98 of pawl 91 will be pressed into engagement with retention surface 166 of activation lever 130 due to the movement of diaphragm 30 along axis 46 toward first fluid chamber 34, such that activation lever 130 remains in the actuated position, until activation lever 130 is manually pivoted to the normal position to reset the switches 114 to their normal states.

Various features of the invention have been particularly shown and described in connection with the illustrated embodiment of the invention, however, it must be understood that these particular arrangements merely illustrate, and that the invention is to be given its fullest interpretation within the terms of the appended claims.

The invention claimed is:

1. A switching device for controlling one or more operable devices, the switching device comprising:

a plurality of switches, each switch including an actuation member adapted to change the switch from a first state to a second state, the switches adapted to be coupled to the one or more operable devices;

an activation lever having a first end and a second end, the second end of the activation lever including an engagement member, the activation lever being pivotal about a first pivot axis between a first position and a second position, the engagement member adapted to engage the actuation members of the switches when the activation lever is in the second position;

a linkage lever pivotal about a second pivot axis between a first position of the linkage lever and a second position of the linkage lever, the linkage lever adapted to engage the activation lever and prevent the activation lever from pivoting from the first position of the activation lever to the second position of the activation lever when the linkage lever is in the first position of the linkage lever, and the linkage lever is adapted to allow the activation lever to pivot from the first position of the activation lever toward the second position of the activation lever when the linkage lever is in the second position of the linkage lever;

whereby when the activation lever is in the first position the engagement member is spaced apart from the actuation members of the switches such that each of the switches is in the first state, and when the activation lever pivots from the first position toward the second position the engagement member substantially simultaneously engages the actuation members of the switches to substantially simultaneously change each switch from the first state to the second state.

2. The switching device of claim 1 wherein the actuation members of the switches are generally aligned with one another along a common linear axis.

3. The switching device of claim 1 wherein the engagement member of the activation lever includes a plurality of fingers, each finger adapted to engage one or more of the actuation members of the switches when the activation lever is in the second position.

4. The switching device of claim 1 including a biasing member adapted to bias the activation lever from the first position toward the second position.

5. The switching device of claim 1 wherein the second end of the activation lever includes a detent member forming a notch, the linkage lever being pivotal about a second pivot axis between a first position of the linkage lever wherein the linkage lever is located within the notch and engages the detent member of the activation lever to prevent the activation lever from pivoting from the first position of the activation lever toward the second position of the activation lever, and a second position of the linkage lever wherein the linkage lever is removed from the notch such that the activation lever may pivot from the first position of the activation lever toward the second position of the activation lever.

6. The switching device of claim 5 wherein the first pivot axis is located between the first end and the second end of the activation lever, the first end of the activation lever including a tab adapted to be manually engaged for manual movement of the activation lever between the first position of the activation lever and the second position of the activation lever, and the detent member of the activation lever including an engagement surface adapted to be engaged by the linkage lever when the linkage lever is in the second position of the linkage lever such that the linkage lever releasably maintains the activation lever in the second position of the activation lever.

7. The switching device of claim 1 including a biasing member adapted to bias the linkage lever from the second position of the linkage lever toward the first position of the linkage lever.

8. The switching device of claim 1 including a sensing mechanism adapted to provide a physical input to the linkage lever in response to a condition sensed by the sensing mechanism, whereby the linkage lever pivots from the first position of the linkage lever toward the second position of the linkage lever in response to the physical input from the sensing mechanism.

9. The switching device of claim 1 wherein the linkage lever includes a leg having a proximal end and a distal end, the proximal end including a pivot member having a third pivot axis, and a pawl coupled to the pivot member, the distal end of the leg and the pawl adapted to conjointly pivot about the third pivot axis of the pivot member, the distal end of the leg adapted to receive an input force to pivot the linkage lever about the third pivot axis, the pawl adapted to engage the activation lever and releasably retain the activation lever in the first position of the activation lever when the linkage lever is in the first position of the linkage lever.

10. The switching device of claim 1 including a pressure sensing mechanism having a housing and a diaphragm located within the housing, the housing including a first fluid chamber and a second fluid chamber, the diaphragm separating the first fluid chamber from the second fluid chamber, the diaphragm being movable with respect to the housing in response to a change in the pressure differential between the pressure of a first fluid in the first fluid chamber and the pressure of a second fluid in the second fluid chamber, the linkage lever being coupled to the diaphragm such that the linkage lever pivots about the second pivot axis in response to movement of the diaphragm, whereby when the diaphragm moves a sufficient distance in response to a selected sensed pressure differential between the pressure of the fluid in the first fluid chamber and the pressure of the fluid in the second fluid chamber the linkage lever pivots from the first position of the linkage lever toward the second position of the linkage lever, whereupon the activation lever pivots from the first position of the activation lever toward the second position of the activation lever to thereby engage the actuating members of the switches.

11. The switching device of claim 10 wherein the housing of the pressure sensing mechanism includes a mounting base having a first side wall and a second side wall, and the linkage lever includes a leg having an elongate first member having a proximal end and a distal end and an elongate second member having a proximal end and a distal end, the proximal ends of the first member and second member being coupled to one another, a first pivot member coupled to the proximal end of the first member of the leg, a second pivot member coupled to the proximal end of second member of the leg, and a pawl coupled to a distal end of the first pivot member, the first pivot member being pivotally coupled to and extending through the first side wall of the mounting base, the second pivot member being pivotally coupled to the second side wall of the mounting base, the pawl being located outwardly from the first side wall of the mounting base and adapted to engage the activation lever when the activation lever is in the first position of the activation lever.

12. The switching device of claim 11 including a seal member located between the proximal end of the first member of the leg and the first side wall of the housing, the first member of the leg adapted to press the seal member into engagement with the first side wall to create a fluid tight seal between the linkage lever and the first side wall of the housing.

13. The switching device of claim 11 wherein the activation lever includes a detent member having a notch, and the pawl includes a rotatable roller adapted to be removably received in the notch of the detent member of the activation lever.

14. The switching device of claim 10 wherein the pressure sensing mechanism includes a calibration mechanism, the calibration mechanism including an adjustment member rotationally coupled to the housing, the adjustment member having a shaft, a guide member threadably coupled to the shaft of the adjustment member, and a resilient biasing member extending between the guide member and the diaphragm such that the biasing member is adapted to bias the diaphragm toward the first fluid chamber with a selected biasing force, whereby the adjustment member is adapted to be rotated to selectively move the guide member along the shaft of the adjustment member to adjust the biasing force provided by the biasing member to the diaphragm.

15. The switching device of claim 14 wherein the adjustment member is located within a bore of the housing, the adjustment member including a generally circular flange and a seal member located between the flange and the housing, the seal member adapted to create a fluid tight seal between the flange and the housing, the guide member including a peripheral edge adapted to engage the housing to prevent the guide member from rotating conjointly with the adjustment member with respect to the housing while allowing the guide member to move linearly along the shaft of the adjustment member with respect to the housing.

16. The switching device of claim 15 wherein the bore of the housing has a polygonal configuration and the peripheral edge of the guide member has polygonal configuration adapted to mate with the polygonal configuration of the bore.

17. A switching device for controlling one or more operable devices, the switching device comprising:

a plurality of switches, each switch including an actuation member adapted to change the switch from a first state to a second state, the switches adapted to be coupled to the one or more operable devices;

an activation lever having a first end and a second end, the second end of the activation lever including an engagement member, the activation lever being pivotal about a first pivot axis between a first position and a second position, the engagement member adapted to substantially simultaneously engage the actuation members of the switches when the activation lever is pivoted from the first position to the second position;

a linkage lever pivotal about a second pivot axis between a first position of the linkage lever and a second position of the linkage lever, the linkage lever adapted to engage the activation lever and prevent the activation lever from pivoting from the first position of the activation lever to the second position of the activation lever when the linkage lever is in the first position of the linkage lever, and the linkage lever is adapted to allow the activation lever to pivot from the first position of the activation lever toward the second position of the activation lever when the linkage lever is in the second position of the linkage lever; and a pressure sensing mechanism having a housing and a diaphragm located within the housing, the housing including a first fluid chamber and a second fluid chamber, the diaphragm separating the first fluid chamber from the second fluid chamber, the diaphragm being movable with respect to the housing in response to a change in the pressure differential between the pressure of a first fluid in the first fluid chamber and the pressure of a second fluid in the second fluid chamber, the linkage lever being coupled to the diaphragm such that the linkage lever pivots about the second pivot axis in response to movement of the diaphragm, whereby when the diaphragm moves a sufficient distance in response to a selected sensed pressure differential between the pressure of the fluid in the first fluid chamber and the pressure of the fluid in the second fluid chamber the linkage lever pivots from the first position of the linkage lever toward the second position of the linkage lever, whereupon the activation lever pivots from the first position of the activation lever toward the second position of the activation lever and substantially simultaneously engages the actuating members of the switches to substantially simultaneously change each switch from the first state to the second state.

18. The switching device of claim 17 wherein the engagement member of the activation lever includes a plurality of fingers, each finger adapted to engage one or more of the actuation members of the switches when the activation lever is in the second position.

19. The switching device of claim 17 wherein the first pivot axis is located between the first end and the second end of the activation lever, the first end of the activation lever including a tab adapted to be manually engaged for manual movement of the activation lever between the first position of the activation lever and the second position of the activation lever, the linkage lever including a pawl and the activation lever including a detent member having an engagement surface adapted to be engaged by the pawl when the linkage lever is in the second position of the linkage lever such that the linkage lever releasably maintains the activation lever in the second position of the activation lever.

20. A switching device for controlling one or more operable devices, the switching device comprising:

a plurality of switches, each switch including an actuation member adapted to change the switch from a first state to a second state, the switches adapted to be coupled to the one or more operable devices;

an activation lever having a first end and a second end, the second end of the activation lever including an engagement member and a detent member forming a notch, the activation lever being pivotal about a first pivot axis between a first position and a second position, the engagement member adapted to engage the actuation members of the switches when the activation lever is in the second position;

a linkage lever pivotal about a second pivot axis between a first position of the linkage lever wherein the linkage lever is located within the notch and engages the detent member of the activation lever to prevent the activation lever from pivoting from the first position of the activation lever toward the second position of the activation lever, and a second position of the linkage lever wherein the linkage lever is removed from the notch such that the activation lever may pivot from the first position of the activation lever toward the second position of the activation lever;

whereby when the activation lever is in the first position the engagement member is spaced apart from the actuation members of the switches such that each of the switches is in the first state, and when the activation lever pivots from the first position toward the second position the engagement member substantially simultaneously engages the actuation members of the switches to substantially simultaneously change each switch from the first state to the second state.

21. The switching device of claim 20 wherein the actuation members of the switches are generally aligned with one another along a common linear axis.

22. The switching device of claim 20 wherein the engagement member of the activation lever includes a plurality of fingers, each finger adapted to engage one or more of the actuation members of the switches when the activation lever is in the second position.

23. The switching device of claim 20 including a biasing member adapted to bias the activation lever from the first position toward the second position.

24. The switching device of claim 20 wherein the first pivot axis is located between the first end and the second end of the activation lever, the first end of the activation lever including a tab adapted to be manually engaged for manual movement of the activation lever between the first position of the activation lever and the second position of the activation lever, and the detent member of the activation lever including an engagement surface adapted to be engaged by the linkage lever when the linkage lever is in the second position of the linkage lever such that the linkage lever releasably maintains the activation lever in the second position of the activation lever.

* * * * *